US006035802A

United States Patent [19]

Lussier

[11] Patent Number: 6,035,802

[45] Date of Patent: Mar. 14, 2000

[54] PERSONAL WATERCRAFT INCLUDING SUPPORT FOR LOWER BACK OF LEG OF RIDER

[76] Inventor: Frank D. Lussier, 110 Lakehill Ct., Belmont, N.C. 28012

[21] Appl. No.: 09/240,083

[22] Filed: Jan. 29, 1999

[51] Int. Cl.[7] ..... B63B 17/00

[52] U.S. Cl. ..... 114/363; 114/55.47

[58] Field of Search ..... 114/55.55, 55.57, 114/363

[56] References Cited

U.S. PATENT DOCUMENTS

| | | | |
|---|---|---|---|
| 4,589,365 | 5/1986 | Masters | 114/347 |
| 4,843,999 | 7/1989 | Kobus et al. | 114/363 |
| 4,982,682 | 1/1991 | Hattori | 114/363 |
| 5,131,346 | 7/1992 | Ohta et al. | 114/363 |
| 5,237,950 | 8/1993 | Abe et al. | 114/363 |
| 5,438,946 | 8/1995 | Kobayashi | 114/363 |
| 5,447,116 | 9/1995 | Kobayashi | 114/363 |
| 5,915,329 | 6/1999 | Watkins | 114/363 |

OTHER PUBLICATIONS

PWC Magazine; Jan./Feb. 1999; Day Tripping by Bruce Hampson; picture of watercraft on p. 25.

*Primary Examiner*—Jesus D. Sotelo

*Attorney, Agent, or Firm*—Kennedy Covington Lobdell & Hickman, LLP

[57] ABSTRACT

A personal watercraft body has an elongate seat for the rider, elongate foot wells each disposed below a respective opposite elongate side of the seat, and sidewalls each extending from a respective opposite elongate side of the seat to a said foot well. Each foot well is defined by a said sidewall, a floor, and an outer wall disposed in facing relation to the sidewall. A back-of-the-leg support member is releasably attached within each foot well beneath each elongate side of the seat and at least part of the bottom of the support member is disposed above a floor of the foot well to define a water passageway. The support members brace the back of the rider's lower legs during riding. Each support member is formed from resilient foam or is pneumatically cushioned and is inflatable, and releasable attachment is provided by frictional engagement between the foot well and the support member. If a rider is thrown from the personal watercraft with sufficient force against the bracing force of a support member, the support member releases from the watercraft to minimize injury to the rider.

37 Claims, 4 Drawing Sheets

PERSONAL WATERCRAFT INCLUDING SUPPORT FOR LOWER BACK OF LEG OF RIDER

FIELD OF THE PRESENT INVENTION

The present invention relates to an improved personal watercraft and, in particular, to a personal watercraft including supports for the lower back of the legs of a rider.

BACKGROUND OF THE PRESENT INVENTION

A "personal watercraft," or so-called "PWC," generally refers to a jet-propelled watercraft for three or fewer persons, each of whom straddles a seat while sitting in tandem one behind the other. Common PWCs include the watercraft sold by Kawasaki under the trademark "Jet Ski" and the watercraft sold by Yamaha under the trademarks "WaveRunner" and "WaveRaider."

A PWC is generally designed to be highly maneuverable on the water and often is driven aggressively at relatively high speeds, often making it difficult for persons riding to remain on the PWC. Furthermore, the condition of the body of water upon which the PWC is ridden also can make it difficult for persons riding to remain on the PWC, especially if the body of water is an ocean. This is true whether the rider is the driver or a passenger.

A number of developments have been made to assist each person in remaining on a PWC. For example, driving gloves have been designed specifically for driving a PWC which include padded sections that enable the driver of the PWC to engage handgrips of the PWC tightly without developing blisters. Straps have also been provided on PWC seats to give passengers something onto which to hold, and seat padding on PWCs have been extended down the sides of the PWC whereby each rider, whether driver or passenger, can grip the PWC between his or her thighs.

In addition thereto, footrests comprising angled inclines have also been designed by manufacturers into the body of the PWC in the foot well areas. Such angled inclines are designed to accommodate the bottom of the foot of a rider for bracing the rider against acceleration of the PWC. This type of foot support is utilized in the PWCs disclosed, for example, in Kobayashi, U.S. Pat. No. 5,447,116, as well as in FIG. 1 of Hattori, U.S. Pat. No. 4,982,682.

While each of these developments has assisted riders in remaining on PWCs, a need continues for the provision of better support and stability for riders which lessens the effort exerted by such riders in remaining on board the watercraft during aggressive or competitive maneuvering.

SUMMARY OF THE PRESENT INVENTION

Briefly summarized, the present invention relates to an improved PWC which provides a rider with greater support and stability during riding. The PWC includes a PWC body having an elongate seat for the rider and elongate foot wells each disposed on respective opposite sides of the PWC body. The PWC body also includes sidewalls each of which extend from respective opposite sides of the seat to a said foot well. Each foot well itself is defined by a said sidewall, a floor, and an outer wall disposed in facing relation to the sidewall.

In the present invention the PWC further includes a pair of back-of-the-leg support members for the rider. Each support member, as its name suggests, provides support for the back of the rider's respective lower legs during riding. This support includes support anywhere along the backside of the lower leg between the foot and knee of the rider, including the Achilles' tendon and/or the calf muscle.

In a feature of the present invention, the PWC includes a pair of back-of-the-leg support members each disposed beneath a respective elongate side of the seat and at a spacing from a said floor of a respective foot well whereby support of the back of the rider's lower legs is provided. In an alternative feature of the present invention, however, each support member partially abuts the floor of the foot well but with a bottom portion thereof being spaced from the floor of the foot well to define a fluid passage whereby water can flow unimpeded along the foot well beyond the support member. Optionally, the support member of the present invention may include a handgrip, a cavity formed therein for holding personal items, such as cans or cups, a contoured leg channel, and a bottom support member with a fluid passageway defined therein for water to flow unimpeded below the support member.

In another feature of the present invention, the PWC includes a back-of-the-leg support member releasably attached within a said foot well between a said sidewall and a said outer wall thereof. The support member is releasably attached to the PWC body whereby if a rider is thrown from the PWC notwithstanding the bracing support by the support member, the force throwing the rider from the PWC acting against the support member will automatically cause the support member to release or breakaway from the PWC body; thus, keeping the rider from being trapped or caught on the PWC. In addition, any injury that might otherwise be caused by the rider being thrown against the support member, such as a broken leg or ankle, will also be avoided.

In the preferred embodiment, each support member preferably is retained in a foot well intermediate the length thereof between an outer wall and a sidewall thereof by frictional engagement. In particular, the support member is preferably wedged or frictionally fitted within the foot well. The support member itself is preferably resilient and made of a foam-like material or pneumatically cushioned. Moreover, it is contemplated that the support member can be inflatable for adjusting the frictional engagement of the support member within the foot well whereby the predetermined force required to release the support member from the foot well can be selectively adjusted. In addition, the inflatability of the support member allows it to be used with a variety of PWCs having differently sized spacings between the outer wall and the sidewall of the foot well.

In view of the above, the present invention consequently also encompasses the method of bracing a back of the lower leg of the rider with a support member that is releasably attached to the personal watercraft, and releasing the support member from the personal watercraft if at least a predetermined force is applied against the support member. The predetermined force is a force which is greater than the acceleration generated by the PWC itself but less than a bracing force capable of trapping the rider on the PWC during a wreck or overturn or causing severe injury to the rider.

BRIEF DESCRIPTION OF THE DRAWINGS

Other features and advantages of the present invention will become apparent to one having ordinary skill in the art in view of the following disclosure of the preferred embodiment of the present invention and with reference to the drawings, in which.

DETAILED DESCRIPTION OF THE PREFERRED EMBODIMENT

Figure 1:
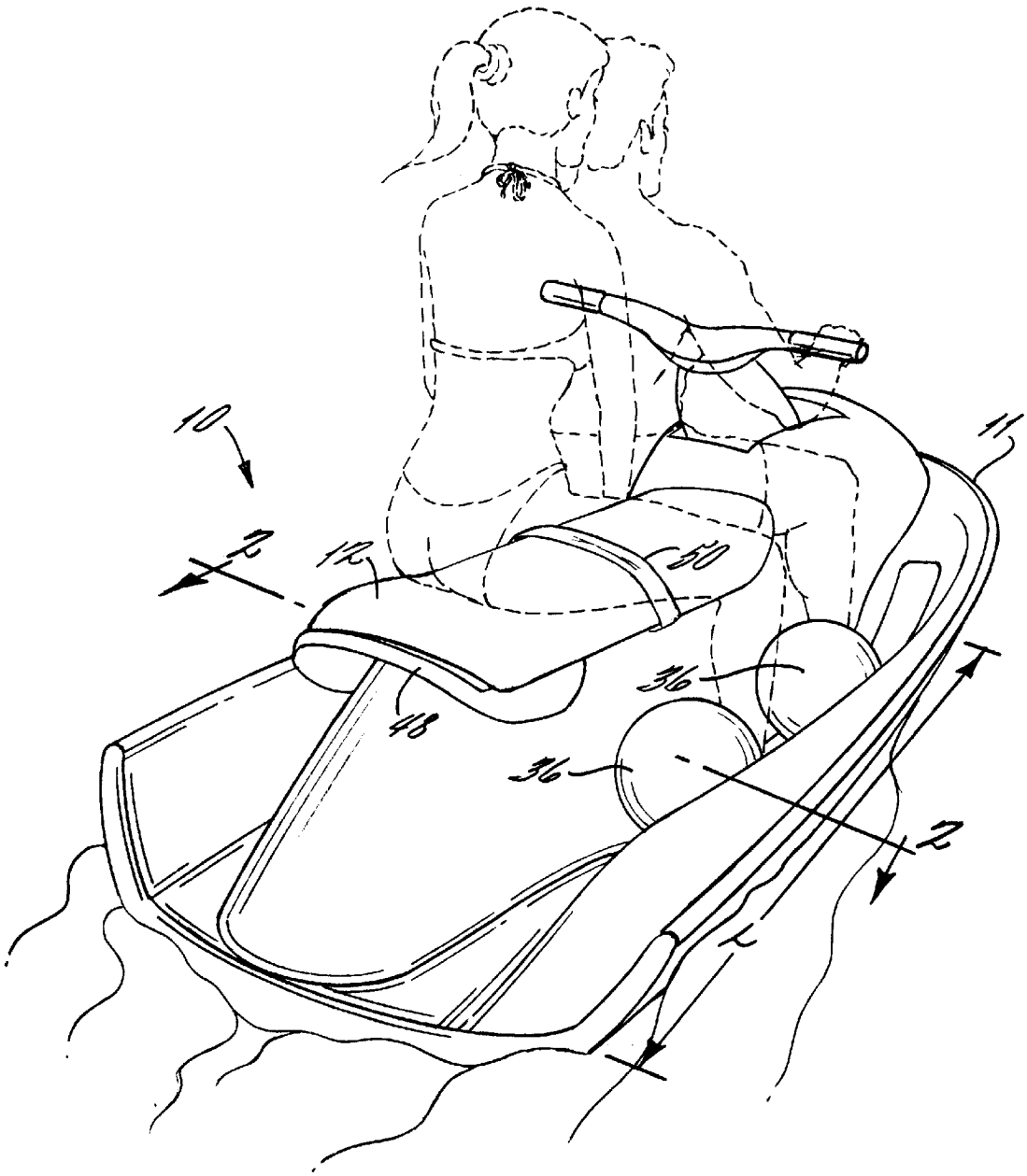
FIG. 1 is a perspective view of the PWC of the present invention.

Referring now to the drawings and first to FIGS. 1 and 2, the PWC 10 of the present invention includes a PWC body 11 having: an elongate seat 12 for one or more riders, elongate foot wells 14,16 each disposed on respective opposite sides 18,20 of and below the seat 12, and sidewalls 22,24 each extending from respective opposite elongate sides 18,20 of the seat 12 to a respective foot well 14,16. Each foot well 14,16 itself is defined by a respective sidewall 22,24 as well as a respective floor 26,28 and a respective outer wall 30,32 of the PWC body 11. Moreover, each outer wall 30,32 is disposed in facing relation to a respective sidewall 22,24 to form a generally U-shaped channel 34 in cross-section defining the foot well 14,16.

A pair of back-of-the-leg support members 36 is provided for each rider, with each support member 36 of the pair preferably but not necessarily being identical to the other. As shown in FIG. 1, each support member 36 is disposed intermediate the elongate length L of the foot well in which it is retained. As shown in FIG. 2, each support member 36 is disposed beneath a said elongate side 18,20 of the seat 12 whereby support of the back of a leg of the rider is provided. Furthermore, while the support member 36 partially abuts the floor 26,28 of the foot well 14,16, a bottom portion of the support member 36 is disposed above the floor 26,28 to define a passage 38 for unimpeded water flow along the foot well 14,16 past the support member 36.

Each support member 36 itself is preferably releasably retained within its respective foot well 14,16. Specifically, each support member 36 is releasably attached within a said foot well 14,16 by frictional engagement thereof between a sidewall 22,24 and an outer wall 30,32 thereof. In essence, each support member 36 of FIGS. 1 and 2 is wedged within a foot well 14,16 and retained therein by the force from compression that it exerts on the sidewall 22,24 and outer wall 30,32. To this end, each support member 36 preferably is resilient and pneumatically cushioned. In the embodiment illustrated, the support member 36 comprises an enclosure containing air with the enclosure itself including flexible membrane-like walls 40.

Figure 2:
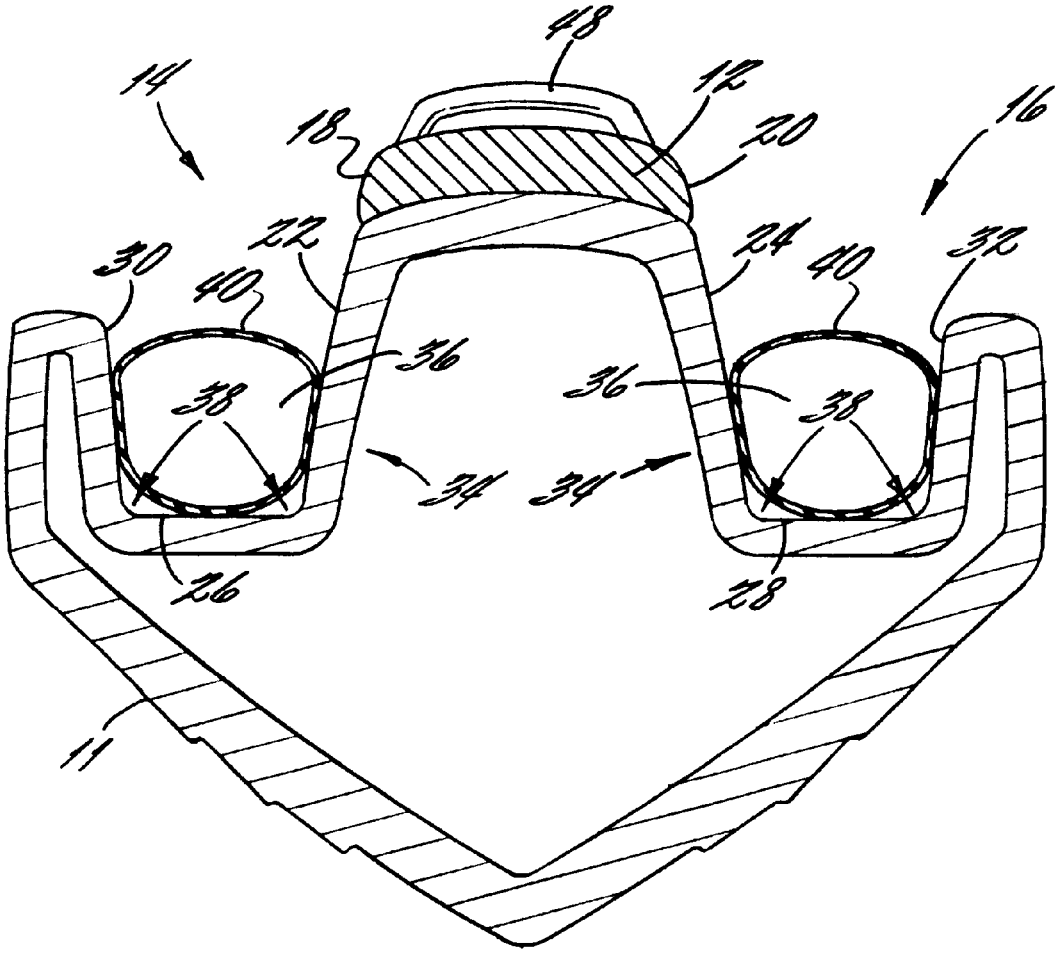
FIG. 2 is an elevational view in cross-section along line 2—2 of the PWC of FIG. 1.

Although not shown in FIGS. 1 or 2, it is contemplated within the present invention that support members 36 may be controllably inflated or deflated whereby the force from compression of the support member 36 which retains the support member 36 within the foot well 14,16 can be selectively adjusted. In addition, when fully or partially deflated, the support member 36 can be selectively positioned within the foot well 14,16 to whatever location is desired by the rider. The support member 36 can then be inflated sufficiently to maintain it in pressure fit against both sides 22,30 and 24,32 of the foot well 14,16 at the desired location. An inflatable support member 36 also provides a comfortable, cushioned feel.

Figure 3:
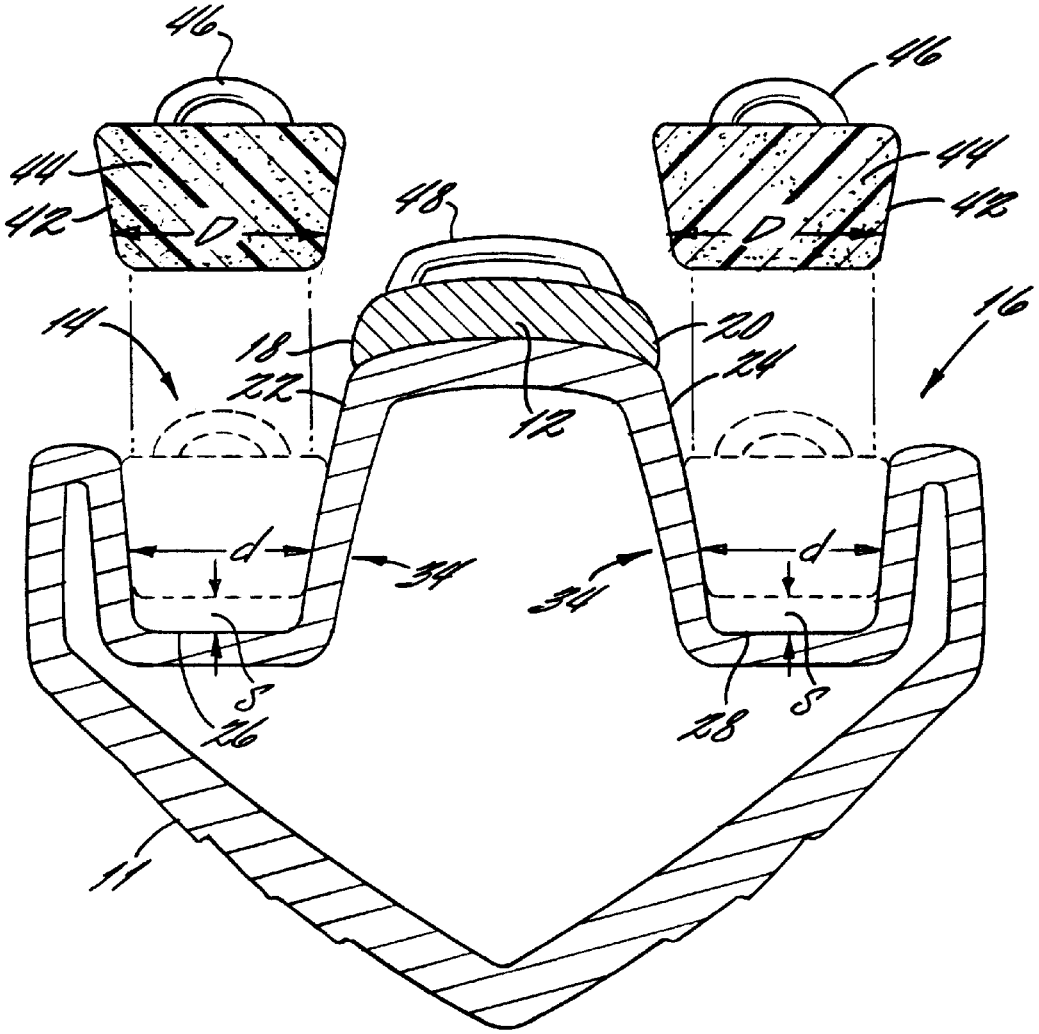
FIG. 3 is an exploded, elevational view in cross-section of another PWC of the present invention.

An alternative preferred embodiment for the support member is shown in FIG. 3, wherein the support member 42 is formed from a resilient foam material 44 and is trapezoidal in shape. Furthermore, a width dimension D of the support member 42 is larger than a width dimension d of the foot well 14,16 whereby the support member 42, when compressed as shown in phantom in FIG. 3, will frictionally fit within the foot well 14,16 up to a spacing S from the floor 26,28 of the foot well 14,16. The support member 42 may also include a handgrip 46, which is secured to the top of support member 42, whereby a passenger of the PWC 10 is provided with convenient handles for holding on to the PWC 10 during riding. This avoids the need for the passenger to hold on to the rider in front, hold on to a grab bar 48 found at the back of the seat 12, or, alternatively, hold on to a strap 50 provided on the seat 12 of the PWC 10. In this particular embodiment, the size of the support member 42 cannot be altered through inflation or deflation.

Figure 4:
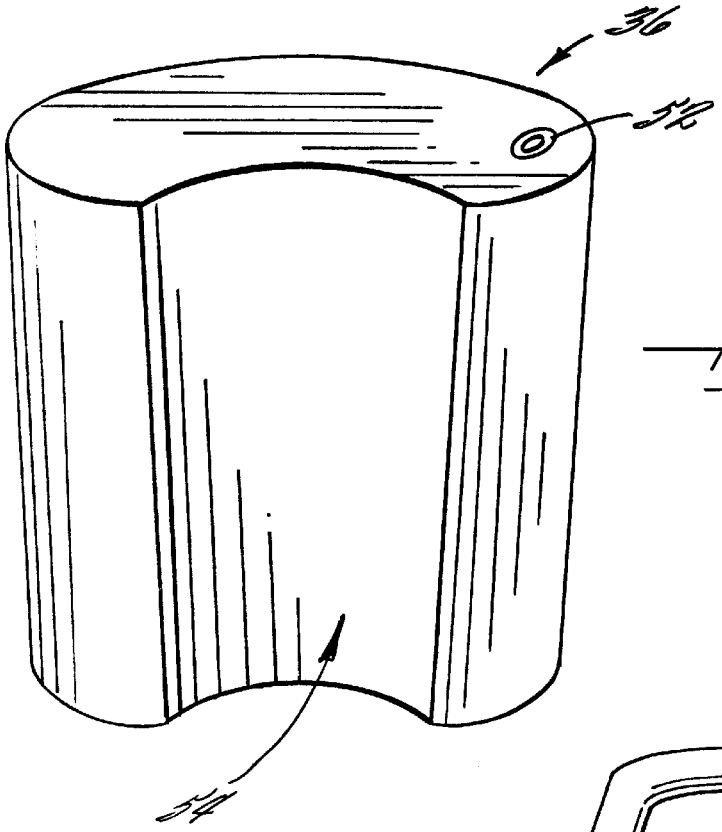
FIG. 4 is a perspective view of one embodiment of the support member of the present invention.
Figure 5:
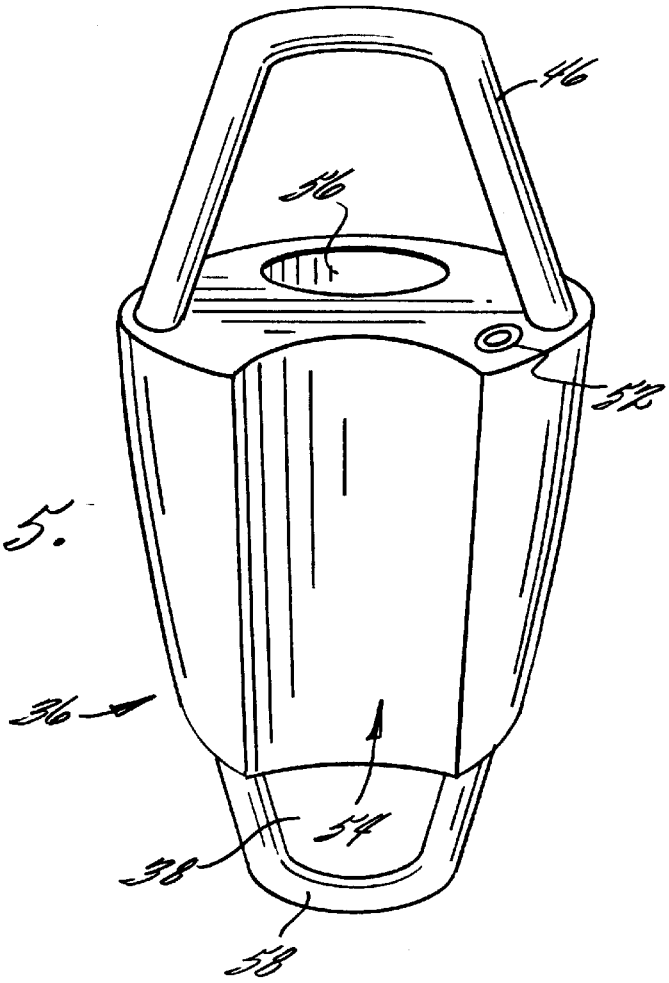
FIG. 5 is a perspective view of another embodiment of the support member of the present invention

Two additional preferred embodiments for the support member 36, having the capability of being inflated, are shown in FIGS. 4 and 5. In each, the support member 36 has an inflation valve 52 by which the support member 36 may be adjustably inflated or deflated for selective placement in or removal from the foot well 14,16. The support member 36 further comprises a leg channel 54, which not only provides a more comfortable contour against which a rider's lower leg may engage the support member 36 but also allows the rider to maintain a tighter grip against the support member 36.

It is contemplated within the present invention that the external contours of support member 36 may be customized to fit within foot wells 14,16 from different manufacturers and having slightly different dimensions. For example, the support member 36 shown in FIG. 5 has a more tapered configuration that the support member 36 shown in FIG. 4. FIG. 5 also illustrates optional features that may be included with any of the support members 36,42 shown in any of the previous Figures. For example, support member 36 may include a handgrip 46, similar to that shown in FIG. 3, whereby a passenger is provided with convenient handles for holding on to the PWC 10 during riding. In addition, support member 36,42 may also include a cavity 56, which may be used to hold personal items, such as cups, cans, coins, keys, or the like. Support member 36,42 may also include a bottom support member 58, which may be used to support the support member 36,42 a predetermined spacing from the floor 26,28 of the foot well 14,16. In this configuration, the bottom support member 58 defines a passage 38 to allow water to flow along the floor 26,28 of the foot well 14,16 and below the support member 36,42.

As will now be recognized, the present invention enables a rider to more easily remain on the PWC and keep from being thrown by positioning the lower portion of the back of his or her leg against the support members of the present invention. Each support member provides a brace against which the rider may exert force for remaining on the PWC during acceleration and, when the driver's legs are properly positioned in front of the support members of the present invention, the driver is able to "hug" and maintain a tighter grip on the PWC using his legs, which, in turn, allows the driver to engage in more rigorous and difficult sporting maneuvers without being thrown or dislodged from the PWC. Furthermore, since each support member is releasably attached to the PWC, upon being thrown from the PWC, the rider will not be trapped or injured by the support member, as the support member will automatically release if necessary.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

It is thus contemplated within the scope of the present invention that support members may be spring-loaded for proper placement and retention within the foot wells, or even molded into the PWC body by the manufacturer, yet still fall within the scope of one or more of the attached claims. The broadest objective of the present invention is simply the support of the lower back of a rider's leg which conventional PWCs currently fail to provide.

What is claimed is:

1. An improved personal watercraft providing a rider with greater support and stability during riding, comprising:

a personal watercraft body having an elongate seat for the rider, elongate foot wells each disposed below a respective opposite elongate side of said seat, and sidewalls each extending from a respective opposite elongate side of said seat to a said foot well, each said foot well being defined by a said sidewall, a floor, and an outer wall disposed in facing relation to said sidewall; and a back-of-the-leg support member disposed on said personal watercraft body beneath a said elongate side of said seat and entirely disposed at a spacing from a said floor of a said foot well, whereby support of the back of the rider's lower leg is provided.

2. An improved personal watercraft according to claim 1, wherein said support member is disposed intermediate the elongate length of said foot well.

3. An improved personal watercraft according to claim 1, wherein said spacing defines a passage for unimpeded water flow along said foot well.

4. An improved personal watercraft according to claim 1, wherein said support member is disposed on a said outer wall.

5. An improved personal watercraft according to claim 1, wherein said support member is disposed on a said sidewall.

6. An improved personal watercraft according to claim 1, wherein said support member extends between and is disposed on both said outer wall and said sidewall.

7. An improved personal watercraft according to claim 1, wherein said support member is inflatable.

8. An improved personal watercraft according to claim 1, wherein said support member is resilient.

9. An improved personal watercraft according to claim 1, wherein said support member is made of foam.

10. An improved personal watercraft according to claim 1, wherein said support member comprises a pneumatic cushion.

11. An improved personal watercraft according to claim 1, wherein said support member includes a contoured leg channel.

12. An improved personal watercraft according to claim 1, wherein said support member includes a handgrip.

13. An improved personal watercraft according to claim 1, wherein said support member defines a cavity for holding personal items.

14. An improved personal watercraft according to claim 1, wherein said support member is releasably attached to both said outer wall and said sidewall.

15. An improved personal watercraft according to claim 14, wherein said releasable attachment comprises frictional engagement of said support member between said outer wall and said sidewall.

16. An improved personal watercraft according to claim 14, wherein said support member is selectively positionable along the length of said foot well.

17. An improved personal watercraft providing a rider with greater support and stability during riding, comprising:

a personal watercraft body having an elongate seat for the rider, elongate foot wells each disposed below a respective opposite elongate side of said seat, and sidewalls each extending from a respective opposite elongate side of said seat to a said foot well, each said foot well being defined by a said sidewall, a floor, and an outer wall disposed in facing relation to said sidewall; and a back-of-the-leg support member releasably attached to said personal watercraft body beneath a said elongate side of said seat, whereby support of the back of the rider's lower leg is provided.

18. An improved personal watercraft according to claim 17, wherein said support member is inflatable.

19. An improved personal watercraft according to claim 17, wherein said support member is resilient.

20. An improved personal watercraft according to claim 17, wherein said support member is made of foam.

21. An improved personal watercraft according to claim 17, wherein said support member comprises a pneumatic cushion.

22. An improved personal watercraft according to claim 17, wherein said support member includes a contoured leg channel.

23. An improved personal watercraft according to claim 17, wherein said support member includes a handgrip.

24. An improved personal watercraft according to claim 17, wherein said support member defines a cavity for holding personal items.

25. An improved personal watercraft according to claim 17, wherein said support member is releasably attached within a said foot well between a said sidewall and a said outer wall thereof.

26. An improved personal watercraft according to claim 25, wherein said releasable attachment comprises frictional engagement of said support member between said outer wall and said sidewall.

27. An improved personal watercraft according to claim 25, wherein said support member is disposed intermediate the elongate length of said foot well.

28. An improved personal watercraft according to claim 25, wherein said support member is selectively positionable along the length of said foot well.

29. An improved personal watercraft according to claim 25, wherein a bottom of said support member only partially abuts said floor of said foot well to thereby define a water passageway.

30. An improved personal watercraft according to claim 25, wherein said support member further comprises a bottom support member; said bottom support member defining a water passageway therethrough.

31. An improved personal watercraft providing riders with greater support and stability during riding, comprising:

a personal watercraft body having an elongate seat for the riders, elongate foot wells each disposed below a respective opposite elongate side of said seat, and sidewalls each extending from a respective opposite elongate side of said seat to a said foot well, each said foot well being defined by a said sidewall, a floor, and an outer wall disposed in facing relation to said sidewall; and two pair of back-of-the-leg support members, each support member of each said pair being disposed beneath a respective said elongate side of said seat whereby support of the back of the lower legs of each rider is provided.

32. An improved personal watercraft according to claim 31, wherein each said support member is entirely disposed at a spacing from a said floor of a said foot well.

33. An improved personal watercraft according to claim 31, wherein each said support member is releasably attached to said personal watercraft body.

34. An improved personal watercraft according to claim 31, wherein each said support member is releasably attached within a said foot well between a said sidewall and a said outer wall thereof.

35. An improved personal watercraft according to claim 34, wherein each said support member is selectively positionable along a length of said foot well.

36. An improved personal watercraft according to claim 34, wherein said releasable attachment comprises frictional engagement of said support member between said outer wall and said sidewall.

37. A method of safely providing a rider of a personal watercraft with greater support and stability during riding, comprising:

bracing a back of the lower leg of the rider with a support member that is releasably attached to the personal watercraft; and releasing the support member from the personal watercraft if at least a predetermined force is applied against the support member.

* * * * *